US007190262B1

(12) United States Patent
Edmondson

(10) Patent No.: US 7,190,262 B1
(45) Date of Patent: Mar. 13, 2007

(54) TRANSPONDER COMMUNICATIONS SYSTEM

(75) Inventor: Jon Bert Edmondson, London (GB)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/857,607

(22) PCT Filed: Dec. 8, 1999

(86) PCT No.: PCT/EP99/09794

§ 371 (c)(1),
(2), (4) Date: Jun. 7, 2001

(87) PCT Pub. No.: WO00/34931

PCT Pub. Date: Jun. 15, 2000

(30) Foreign Application Priority Data

Dec. 9, 1998 (EP) ..... 98310082

(51) Int. Cl.
*G08B 1/08* (2006.01)

(52) U.S. Cl. ..... 340/539.1; 340/426.13; 340/426.15; 340/426.16; 340/438; 340/905; 340/933

(58) Field of Classification Search ..... 340/539.1, 340/426.13, 426.15, 426.16, 438, 905, 933
See application file for complete search history.

(56) References Cited

U.S. PATENT DOCUMENTS 5,448,110 A 9/1995 Tuttle et al. ..... 257/723
5,742,773 A 4/1998 Blomfield-Brown et al. .... 395/200.58
5,748,106 A 5/1998 Schoenian et al. ..... 622/530
6,097,313 A * 8/2000 Takahashi et al. ..... 340/905

FOREIGN PATENT DOCUMENTS

| | | |
|---|---|---|
| EP | 0 644 515 | 3/1995 |
| WO | WO95 01607 | 1/1995 |
| WO | WO 98/05171 | 2/1998 |
| WO | WO 98/23039 | 5/1998 |
| WO | WO98 25248 | 6/1998 |

* cited by examiner

*Primary Examiner*—Daryl C Pope

(57) ABSTRACT

A unit (1) for use in a vehicle is interrogated and identified by a fixed interrogator (2). A wireless form of communication is established between the unit (1) and interrogator (2) to permit transfer of data to the unit (1). As well as appropriate communication circuitry (12) and an identification store (19), the unit (1) includes processing of the incoming data by a microprocessor (32) to provide an audio signal for energizing a loud speaker (36) in the unit (1) to provide a sound output for the vehicle occupants. The unit is powered by internal batteries (22, 38) to be usable even when the vehicle ignition is turned off. The unit (1) is made self-contained to be mounted wherever convenient. The principle can be extended to providing data to control a visual display in the unit (1). The unit (1) may be provided with a user-interactive input such as a keypad (48). A radio link is described but other wireless means of communication are feasible.

8 Claims, 1 Drawing Sheet

TRANSPONDER COMMUNICATIONS SYSTEM

Figure 1:
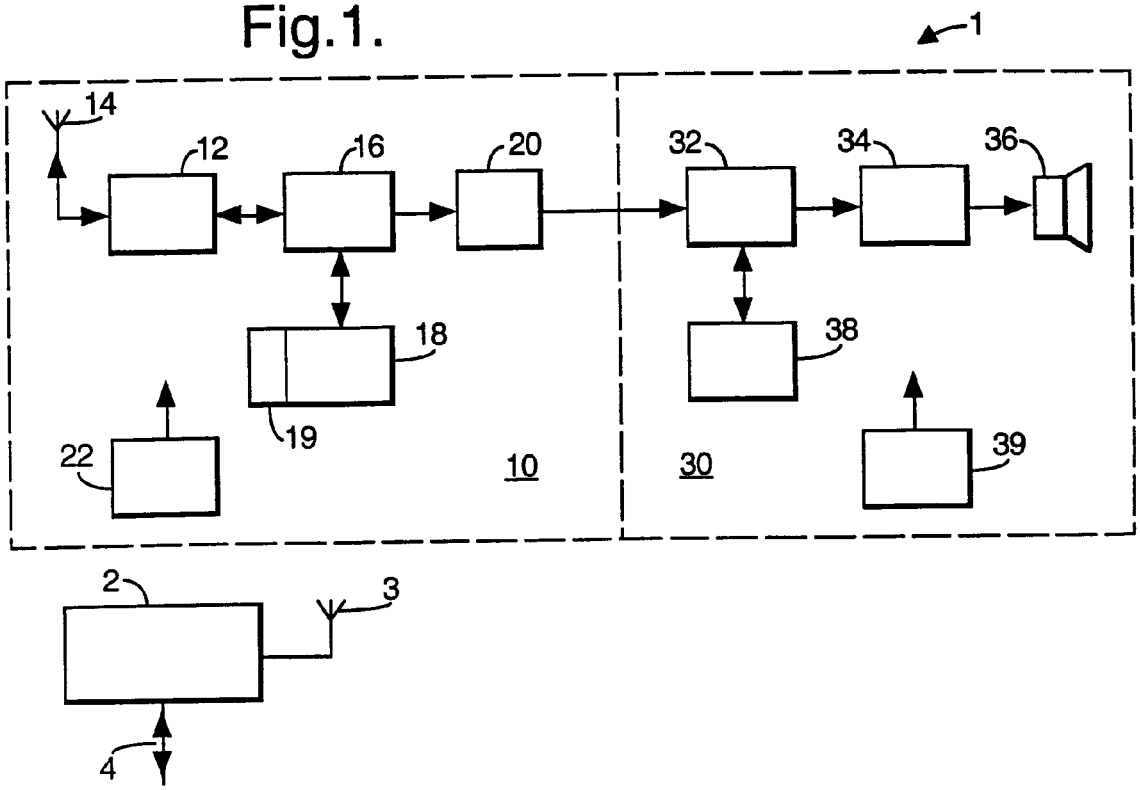

This invention relates to a unit for providing messages emanating from a remote station to a user. The unit can be carried in a vehicle or it can be carried by the user. The communication is wireless, that is by a mode that requires no tangible communication circuit between the fixed and mobile stations.

International patent application publication No. 95/01 607 discloses a unit for providing messages emanating from a remote station to a user, comprising a transponder section for communicating with the remote station by a wireless mode of communication, and a data processing section, wherein the transponder section includes means for storing an identification code, means that are responsive to an interrogation signal from the remote station to emit an identification signal bearing the identification code, means that are responsive to incoming data signals including an address code, which may be the same as or derived from the identification code, and means for providing the incoming data to the data processing section, and wherein the data processing section includes means for providing an audio and/or visual output for the user of the unit.

In International patent application publication No. 98/25 248 a radio frequency identification system is described that is applied to a vehicle in which there is an on-board computer system for monitoring and reporting parameters relating to various engine functions in combination with radio frequency identification transponder circuitry linked to the computer by a serial bus. The radio frequency identification system communicates with a fixed interrogator over a radio link. The radio frequency identification circuit has a unique identification code. In response to a signal from the interrogator the radio frequency identification circuit responds by identifying itself and parameter data is sent to the interrogator through the radio frequency identification transponder.

International patent application publication No. 98/05 171 describes a radio frequency identification device with adjustable receiver sensitivity. It discloses the implementation of this type of device in a compact form, such as in an identification card, using a thin profile button-type battery. U.S. Pat. No. 5,448,110 also addresses the problems of fabricating a compact radio frequency identification transceiver assembly in a low profile, flat, form. It discloses the possibility of transferring into an internal memory data received from a remote external interrogator and transmitting data stored in the internal memory.

The present invention is concerned with apparatus in a vehicle which enables information or entertainment and messages in general to be provided to the driver or other occupants of the vehicle.

The invention has been developed in connection with particular circumstances in which communications with the interior of the vehicle is difficult, for example in a car wash where the car radio aerial is retracted, the car is closed up. It is difficult to reliably supply information or entertainment at this point. The other circumstance is where the ignition is switched off leaving the car radio inoperative.

It is an object of the present invention to provide a unit that allows making audio messages available through audio equipment installed in the vehicle.

According to the present invention there is provided a unit for providing messages emanating from a remote station to a user, comprising a transponder section for communicating with the remote station by a wireless mode of communication, and a data processing section, wherein the transponder section includes means for storing an identification code, means that are responsive to an interrogation signal from the remote station to emit an identification signal bearing the identification code, means that are responsive to incoming data signals including an address code, which may be the same as or derived from the identification code, and means for providing the incoming data to the data processing section, and wherein the data processing section includes means for providing an audio and/or visual output for the user of the unit, characterized in that the unit further comprises means responsive to the audio output to generate a modulated signal for emitting externally of the unit.

Another circumstance is where the ignition is switched off leaving the car radio inoperative and the electrical system of the vehicle is dead. Therefore a further object of the present invention is to provide a self-contained unit.

To this end the present invention provides a unit for providing messages emanating from a remote station to a user, comprising a transponder section for communicating with the remote station by a wireless mode of communication, and a data processing section, wherein the transponder section includes means for storing an identification code, means that are responsive to an interrogation signal from the remote station to emit an identification signal bearing the identification code, means that are responsive to incoming data signals including an address code, which may be the same as or derived from the identification code, and means for providing the incoming data to the data processing section, and wherein the data processing section includes means for providing an audio and/or visual output for the user of the unit, characterized in that the unit is contained within a housing including one or more batteries for powering the transponder section and the data processing section.

Figure 2A:
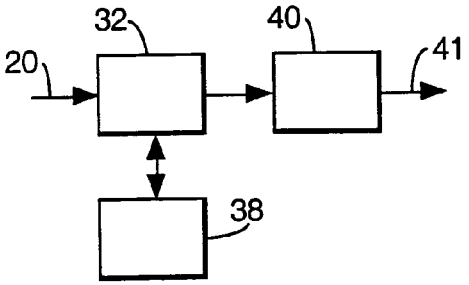
Figure 2B:
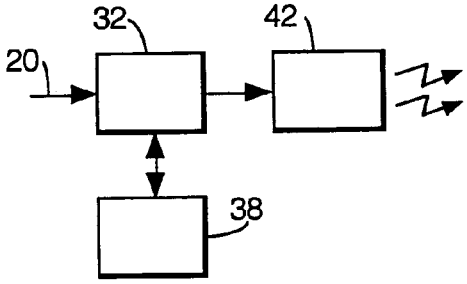
Figure 2C:
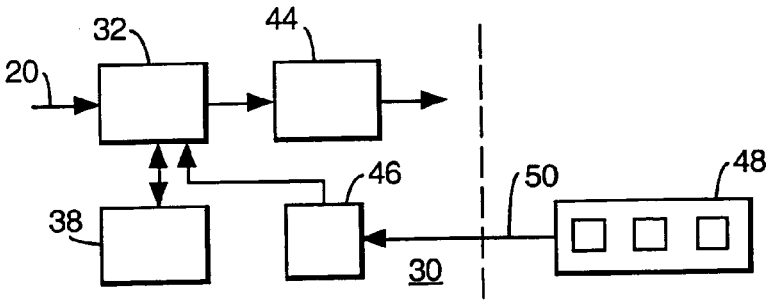

The invention will now be described in more detail with reference to the accompanying drawings, wherein FIG. 1 is a block diagram of a system incorporating a unit in accord with the invention; and FIGS. 2A, 2B and 2C show diagrams of modifications to the processing section of the unit of FIG. 1.

The embodiment of the invention illustrated in FIG. 1 will be described in the context of a unit intended to be mounted in a vehicle, and more particularly within the saloon of the vehicle, to provide messages of various kinds to the driver or other occupant of the vehicle. The wireless mode of communication assumed for purposes of illustration is a radio link which may be one using spread spectrum techniques to enhance security and the selective communication of the fixed or remote station with a desired vehicle unit. Wireless links include, in addition to radio, magnetic induction, sound waves, particularly ultrasonic, and optical, e.g. infra-red. The radio communication between the fixed station and the vehicle unit in the system to be described, uses very low power. In many countries frequency bands are assigned for low power, short range, communication without the necessity of licensing.

The circuit to be described is constructed as a self-contained unit 1. The unit 1 is located within a housing or case adapted to be mounted or attached at a suitable location within the vehicle. The unit 1 can be broadly considered in two parts, a transponder section 10 for communicating with a remote station 2 and a data processing section 30 for providing an audio output to the vehicle occupant. The remote station 2 radiates radio signals through antenna 3 and may be linked as at 4 to a central network. The unit 1 is intended to provide audio and/or visual information or entertainment or messages in general to the driver or other vehicle occupants. The description that follows will initially concentrate on an audio output. The transponder section 10 communicates with the remote station 2 by a radio link.

The transponder section 10 includes a receiver/transmitter unit 12 providing a transceiver facility for receiving and transmitting radio signals through an antenna 14 contained within the housing. A transponder microprocessor 16 has associated with it a memory 18 storing an identification code, specific to the transponder section 10, permanently resident in a section 19 of memory 18. The transfer of data between the unit 1 and the remote station 2 may be accomplished using a packet mode of transmission.

The transponder microprocessor 16 implements the program routines controlling the transponder section 10. These routines may be stored in memory 18 or elsewhere.

The memory 18 may be on-chip or separate from the transponder microprocessor 16.

The transponder section 10 also has a data port 20, e.g. a serial port, through which data is sent to the processing section 30. As will be described later the data communication through the data port 20 may be made bi-directional to add interactive facilities for the user. The unit 1 is self-powered so that it includes at least one battery 22 and 39 for powering the transponder and processing sections 10 and 30. The battery requirements are discussed further below. As illustrated the transponder section 10 has its own battery 22.

In operation, when it is in range the transponder section 10 responds to an interrogation signal from remote station 2 that is sent continuously or at regular intervals. The interrogation signal is recognised by the transponder microprocessor 16 and it responds by causing the identification code in section 19 of memory 18 to be sent to the remote station 2 where it is stored to enable subsequent selective addressing of the transponder section 10. The address code may be the identification code or a code derived from it, i.e. part of the identification code, or it may be a code established at the time by the remote station 2 and stored in memory 18 for enabling transactions to be selectively established with unit 1. By this means data signals can be specifically directed to a given vehicle, even if other vehicles are within range. The nature and purpose of the data is discussed further below. The data addressed to unit 1 is extracted and formatted into a data stream by the transponder microprocessor 16 and sent to the processing section 30 through the data port 20.

The processing section 30 is designed to use the incoming data to provide an audio signal may be used to provide an eventual external aural or audible signal (FIG. 2A) or it may be used directly in the unit 1 to provide a sound output within the vehicle for the driver or other occupants. In processing section 30 the processing is controlled and the data are decoded by a processing microprocessor 32. The processing micro-processor 32 receives a stream of serial data through the data port 20. This data is to be decoded to an audio signal, e.g. an announcement or music, which is output to an audio output stage 34 driving a speaker 36 which is contained within the housing of unit 1 with appropriate provision for emitting the sound output. Under some circumstances it may be desired that the delivery of the audio signal is not to be done immediately as the data stream arrives but is to be triggered at a later time. The processing microprocessor 32 has associated with it an extended memory 38 in which the data stream can be stored until required for decoding. It is contemplated that the incoming data will be in the form of compressed data files, so that memory space (random access memory, or RAM) will be required in any event in connection with the expansion and decoding of the compressed data files. The data stream may also need decryption where data is sent from the remote station in an encrypted form. This process may be implemented to allow playing of portions of the audio or video message while the remainder is still being decoded. The illustrated processing section 30 contains its own battery 39 which has to be of sufficient capacity to power the audio output stage 34 to drive a small speaker 36. It will be appreciated that since the transponder section 10 and the processing section 30 are intended to be parts of a single unit 1, a single battery may be used to power both sections 10 and 30.

To exemplify one use of the unit 1 described thus far, it can be used to provide information or music within a vehicle going through a car wash. A remote station 2 in the form of a fixed interrogator unit can be mounted adjacent the entry to the car wash to activate and identify the unit 1, and to address a data stream to it. This data stream can be decoded immediately to play the message or music while the vehicle is going through the car wash. Another possibility is to load the data stream elsewhere in a service station so that it is available should the vehicle then enter the car wash facility. The data stream is stored in memory and a trigger signal is provided on entering the car wash to cause the message/music to be played. In this case a remote station may be located at the entry to the car wash to transmit an appropriate trigger signal recognised by the transponder section 10 to initiate playback of the stored message.

It will be realised that the above-described unit 1 is capable of providing the aural output for the vehicle occupant even in circumstances where the ignition is turned off and the electrical system of the vehicle is dead. Even if the electrical power is available within the vehicle, the self-contained nature of the unit 1 means that it functions without reliance on other electrical equipment within the vehicle together with any special provision that may need to be made to link the unit 1 to other electrically-powered equipment. An advantage of such a unit is that it can be used both inside a vehicle as well as outside the vehicle. The interactivity with the user then can include providing information on the position, making notes, making hotel reservations.

However, it is envisaged that for audio messages, advantage could be taken of audio equipment installed in the vehicle. FIG. 2A shows that the unit 1 further comprises means in the form of a very low power frequency modulation or FM transmitter 40 which is responsive to the output of the processing microprocessor 32. The means 40 generate a modulated signal 41 for emitting externally of the unit 1.

FIGS. 2B and 2C also indicate other modifications. FIG. 2B shows the possibility of using a visual display arrangement 42 within the unit 1, such as one using a liquid crystal display mounted to a wall of the housing to display visual messages externally of the housing. This could be done in addition to or instead of the audio message output described above.

Another development is to provide some inter-activity from within the vehicle; for example by selection of options presented to the occupant. People are used to exercising options via key-pad operated devices. FIG. 2C shows a modification in which the processing microprocessor 32 provides an output to the user via an output device generally indicated as 44 (this may be audio and/or visual) and there is provided an input port or interface 46 within processing section 30 which is connected to the processing microprocessor 32 and by means of which a user-operable input device, for example a key pad 48, is linked to provide input signals to the processing microprocessor 32. If the input device is a key-pad, while it may be incorporated in the unit 1, for convenience of use, it may be preferable to have the keypad 48 external to the unit 1 as shown. The connection to the unit 1 may be made by a link 50 such as a cable or by infra-red. However, the interactivity by the user could be provided by voice commands in which case it may be possible to mount a voice responsive component as a part of the unit 1.

In the illustrated case key actuation is recognized by the processing microprocessor 32 which generates a code corresponding to the actuated key. This code is returned to the transponder microprocessor 16 via the serial port 20. The transponder microprocessor 16 will then initiate a digitally coded signal for return to the remote station 2. The external action taken thereafter need not be restricted to providing information directly for the occupant. Data may be provided to other means within the unit 1 with, if desired, an acknowledgement for the occupant of the action taken. For example, it may be concerned with up-dating the sum available in a credit card memory connected to the transponder microprocessor 16.

Although the practice of the invention has been described in relation to a self-contained unit 1 for use within a vehicle, a wider utility is envisaged. For example, it could be used to call up commentaries or specific information directed to user in museums, galleries and the like. The user can selectively obtain the wanted information without affecting other users in the vicinity. In such a case any audio output may be better provided to the user by headphones plugged into a socket on the housing of the unit 1. A headphone socket 40 is shown in FIG. 1. It may be an alternative to the speaker 36 or arranged to cut out the speaker when the headphones are plugged in.

The unit which has been described, together with its various modifications has been discussed in terms of a transponder section providing the facilities to communicate on the one hand with a remote station, and on the other hand communicating internally with the processing section; and a processing section in data communication with the transponder section on the one hand and on the other hand providing the audio and/or visual communication within the user. It will be understood that in order to perform the functions described a practical unit 1 may use a single microprocessor to perform the functions of the transponder microprocessor 16 and the processing microprocessor 32 and a single block of addressable memory to perform the functions of memories 18 and 38. To enhance fabrication into a compact, integrated unit, a single battery would be preferable. The batteries used in the practice of the invention may be of a rechargeable kind.

Mention has been made above of sending data by means of compressed files. International patent application publication No. 98/23 039 describes concatenation compression for real-time voice and data processing. Another example of a compression technique for audio and data signals sent from one site to another is described in U.S. Pat. No. 5,742,773.

The remote station can not only be placed at a car wash station, it can also be placed on a forecourt of a refuelling station or at a gate or a drive-through window.

What is claimed is:

1. A unit for providing messages emanating from a remote station to a user, comprising a transponder section for communicating with the remote station by a wireless mode of communication, and a data processing section, wherein the transponder section includes means for storing an identification code, means that are responsive to an interrogation signal from the remote station to emit an identification signal bearing the identification code, means that are responsive to incoming data signals including an address code, which may be the same as or derived from the identification code, and means for providing the incoming data to the data processing section, and wherein the data processing section includes means for providing an audio and/or visual output for the user of the unit, further characterized in that the unit further comprises means responsive to the audio output to generate a modulated signal for emitting externally of the unit.

2. The unit of claim 1, wherein the unit is contained within a housing including one or more batteries for powering the transponder section and the data processing section.

3. A unit for providing messages emanating from a remote station to a user, comprising a transponder section for communicating with the remote station by a wireless mode of communication, and a data processing section, wherein the transponder section includes means for storing an identification code, means that are responsive to an interrogation signal from the remote station to emit an identification signal bearing the identification code, means that are responsive to incoming data signals including an address code, which may be the same as or derived from the identification code, and means for providing the incoming data to the data processing section, and wherein the data processing section includes means for providing an audio and visual output for the user of the unit, further characterized in that the unit is contained within a housing including one or more batteries for powering the transponder section and the data processing section.

4. The unit of claim 3, wherein the unit further comprises means responsive to the audio output to generate a modulated signal for emitting externally of the unit.

5. The unit according to any one of the preceding claims, wherein the means for providing an audio and/or visual output at least includes means for providing an aural output.

6. The unit of claim 3, wherein the unit further comprises means for receiving an input from a user and to initiate a signal from the transponder for communicating the user input to the remote station.

7. The unit of claim 6 further comprising a keypad or keyboard for generating the user input.

8. The unit of claim 3 further comprising means for linking the unit to an external device, which external device is operable by the user to generate inputs to the unit.

* * * * *